US009266001B1

(12) United States Patent
Leon

(10) Patent No.: US 9,266,001 B1
(45) Date of Patent: Feb. 23, 2016

(54) BASEBALL PITCHER TRAINING DEVICE AND METHOD

(71) Applicant: Raymond Leon, Bridgewater, NJ (US)
(72) Inventor: Raymond Leon, Bridgewater, NJ (US)

( * ) Notice: Subject to any disclaimer, the term of this patent is extended or adjusted under 35 U.S.C. 154(b) by 0 days.
(21) Appl. No.: 14/538,899
(22) Filed: Nov. 12, 2014
(51) Int. Cl.
*A63B 69/00* (2006.01)
*A63B 43/00* (2006.01)
*A63B 37/08* (2006.01)
*A63B 67/00* (2006.01)
(52) U.S. Cl.
CPC ..... *A63B 69/0002* (2013.01); *A63B 43/002* (2013.01); *A63B 37/08* (2013.01); *A63B 43/007* (2013.01); *A63B 67/00* (2013.01); *A63B 2043/001* (2013.01); *A63B 2069/0006* (2013.01)
(58) Field of Classification Search
CPC ..... A63B 69/0002; A63B 43/002; A63B 43/008; A63B 43/007; A63B 37/08; A63B 67/00; A63B 43/00; A63B 43/02
USPC ..... 473/450, 458, 464, 451, 575, 569, 424, 473/596, 423, 506, 425, 422; D21/466, D21/707, 719, 713; 116/173
See application file for complete search history.

(56) References Cited

U.S. PATENT DOCUMENTS 4,088,319 A * 5/1978 Clarke ..... A63B 43/02 473/575
4,175,744 A 11/1979 Llewellyn
4,657,253 A * 4/1987 Lerner ..... A63B 43/02 473/576
4,696,472 A * 9/1987 Meyer ..... A63B 43/02 473/575
4,826,179 A * 5/1989 Callaghan ..... A63H 33/18 473/575
4,930,773 A 6/1990 Outlaw
5,112,061 A * 5/1992 Lamle ..... A63B 37/08 473/473
D356,354 S * 3/1995 Killion ..... D21/436
5,474,301 A * 12/1995 Wilson ..... A63C 19/06 473/490
5,557,687 A * 9/1996 Hara ..... G06F 19/3487 382/132
5,639,243 A 6/1997 Ryan et al.
5,706,756 A * 1/1998 Cunningham ..... G09F 17/00 116/173
D396,256 S * 7/1998 Shaw ..... D21/707
5,820,495 A 10/1998 Howland
6,050,907 A * 4/2000 Long ..... A63B 69/0075 473/451
D480,902 S * 10/2003 Long ..... D21/466
7,100,539 B2 * 9/2006 Levan ..... A01K 15/026 119/707
7,297,078 B2 11/2007 Libonati
D661,848 S * 6/2012 Byrne ..... D30/160
8,668,602 B1 * 3/2014 Kieffaber ..... A63B 65/02 473/417
8,771,106 B1 * 7/2014 Boulanger ..... A63B 43/007 473/422
9,132,329 B2 * 9/2015 Ebert ..... A63B 69/0002 473/451
2015/0217178 A1 * 8/2015 Fisher ..... A63B 71/00 273/317

FOREIGN PATENT DOCUMENTS

FR 2681255 A1 * 3/1993 ..... A63B 69/00
GB 2051586 A * 1/1981 ..... A63B 43/00
KR WO2008018773 A3 2/2008

* cited by examiner

*Primary Examiner* — Mitra Aryanpour
(74) *Attorney, Agent, or Firm* — Thomas J. Germinario

(57) ABSTRACT

A device for training a pitcher to complete his/her delivery with a full follow-through consists of a pliable, sheet-like tail member attached to an official-size baseball with conventional seams. Multiple apertures provided for the attachment of the tail member to the ball enable the tail member to be positioned relative to the seams so as not to obstruct various pitching grips. The ball is free to rotate independently of the tail member, so that the trainee pitcher can practice various pitches in which spin is applied to the ball. Upon completion of the pitcher's delivery, a full follow-through is indicated by an audible snapping of the distal end of the tail member.

6 Claims, 3 Drawing Sheets

BASEBALL PITCHER TRAINING DEVICE AND METHOD

FIELD OF INVENTION

The present invention relates generally to devices and methods for training athletes, and more particularly to devices and methods for training baseball pitchers.

BACKGROUND OF THE INVENTION

Baseball pitchers commonly use an exercise known as "throw the towel" to improve the follow-through of their delivery. In this exercise, a small hand towel is knotted at one end, and the pitcher grips the knotted end in his/her pitching hand as if it were a baseball. The pitcher then completes his/her delivery without releasing the towel. Audible "snapping" of the unknotted end of the towel at the completion of the pitcher's delivery is indicative of a full follow-through and efficient pitching mechanics. In addition to providing feedback to improve pitching mechanics, the "throw the towel" exercise also provides resistive training for arm muscles and increases arm speed.

But the conventional "throw the towel" exercise falls short of simulating an actual pitcher's delivery in several respects. The towel knot does not have the size, shape or weight of an official baseball, nor does it have a baseball's seams, by which the pitcher's fingers grip the ball. Moreover, because the knot cannot move independently of the entire towel, the ability of the pitcher's hand to rotate as he/she completes his/her delivery is severely constrained. The lack of seams on the towel knot also prevents the trainee pitcher from practicing different grips associated with various pitches, such "four-seam" and "two-seam" fastballs, change-ups and assorted breaking pitches.

SUMMARY OF THE INVENTION

In order to better simulate the mechanics of a pitcher's delivery, the present invention provides a training device comprising an official-size baseball with an attached sheet-like, pliable tail member. The baseball has the traditional horseshoe-shaped seams, which may be stitched seams or simulated stitching.

The tail member is attached to the baseball through one of multiple apertures, which are variously positioned relative to the seams, so as to allow the trainee pitcher to alter his/her grip on the seams without obstruction from the tail member. This feature is advantageous because it allows the trainee pitcher to practice a variety of pitches calling for different grips on the seams.

Preferably, the tail member is attached to the baseball so that the ball is free to rotate independently of the tail member. This feature allows the trainee to apply rotation to the ball in the course of his/her delivery, as he/she would in actually delivering a pitch. Rotatable attachment of the tail member to the baseball can be accomplished by the conjugate coupling of a spherical extension at the proximal end of the tail member with a spherical socket inside the baseball.

Optimally, the shape of the tail member is substantially rectangular, with a proximal corner attached to the baseball and a distal corner that snaps upon completion of a pitching delivery with full follow-through. Interchangeable tail members of various sizes can be provided, so that a trainee pitcher can progress from smaller to larger tail members as his/her arm strength increases.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
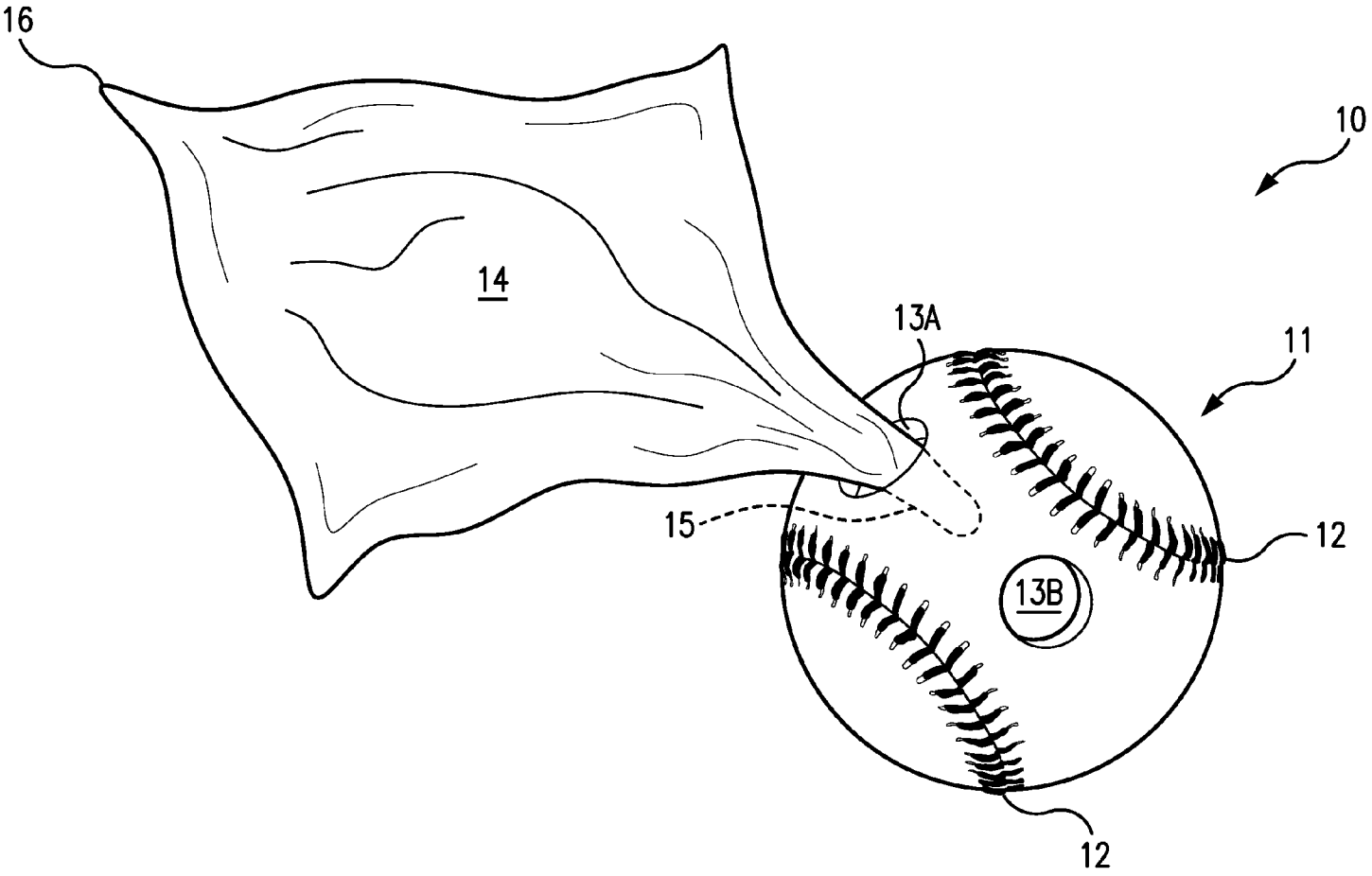
FIG. 1 is a perspective view of a baseball pitcher training device according to one embodiment of the present invention.

Referring to FIG. 1, the pitcher training device 10 comprises an official-size baseball 11 having the traditional horseshoe-shaped seams 12. The baseball has a primary aperture 13A and a secondary aperture 13B. The tail member 14 is a substantially rectangular, pliable sheet-like material, such as fabric or pliable plastic. It has a proximal end 15, which is removably rotatably attached to the baseball 11, and a distal end 16, which accelerates with a snapping sound as the pitcher completes his/her delivery with a full follow-through. The secondary aperture 13B is provided so that the tail member 14 can be repositioned in relation to the seams 12, so as to allow different grips on the seams 12 without obstruction from the tail member 14.

Figure 2:
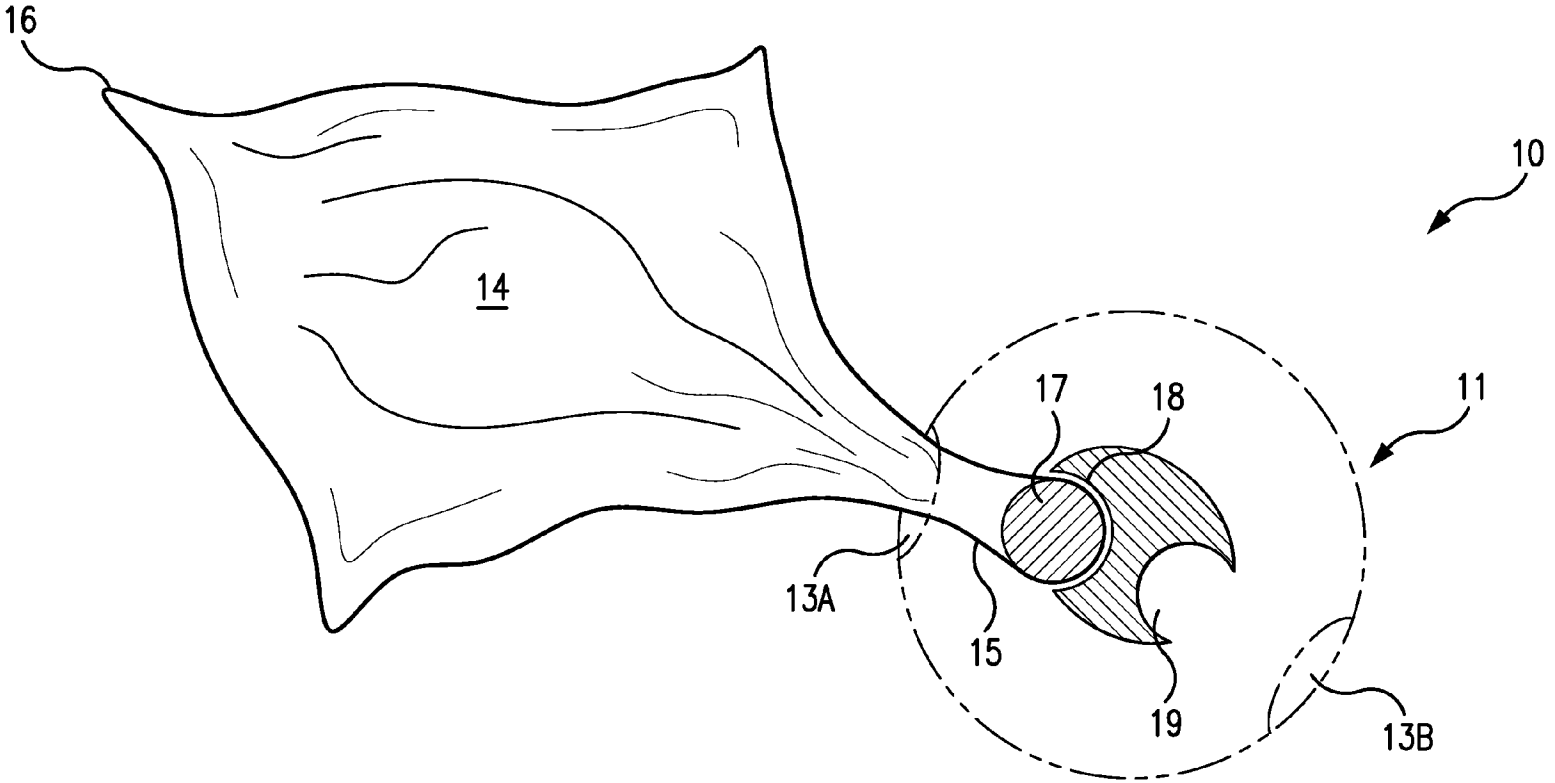
FIG. 2 is a cutaway view of the baseball pitcher training device illustrating the rotatable attachment of the tail member to the baseball using a ball-and-socket connection.

Referring to FIG. 2, a cutaway view of the pitcher training device illustrates one method by which the tail member 14 can be removably rotatably attached to the baseball 11 through either the primary aperture 13A or the secondary aperture 13B. A spherical extension 17 provided on the proximal end 15 of the tail member 14 conjugately couples with either a primary socket 18 or a secondary socket 19, thus allowing the tail member 14 to be rotatably attached to the ball 11 either through the primary aperture 13A or the secondary aperture 13B.

Figure 3:
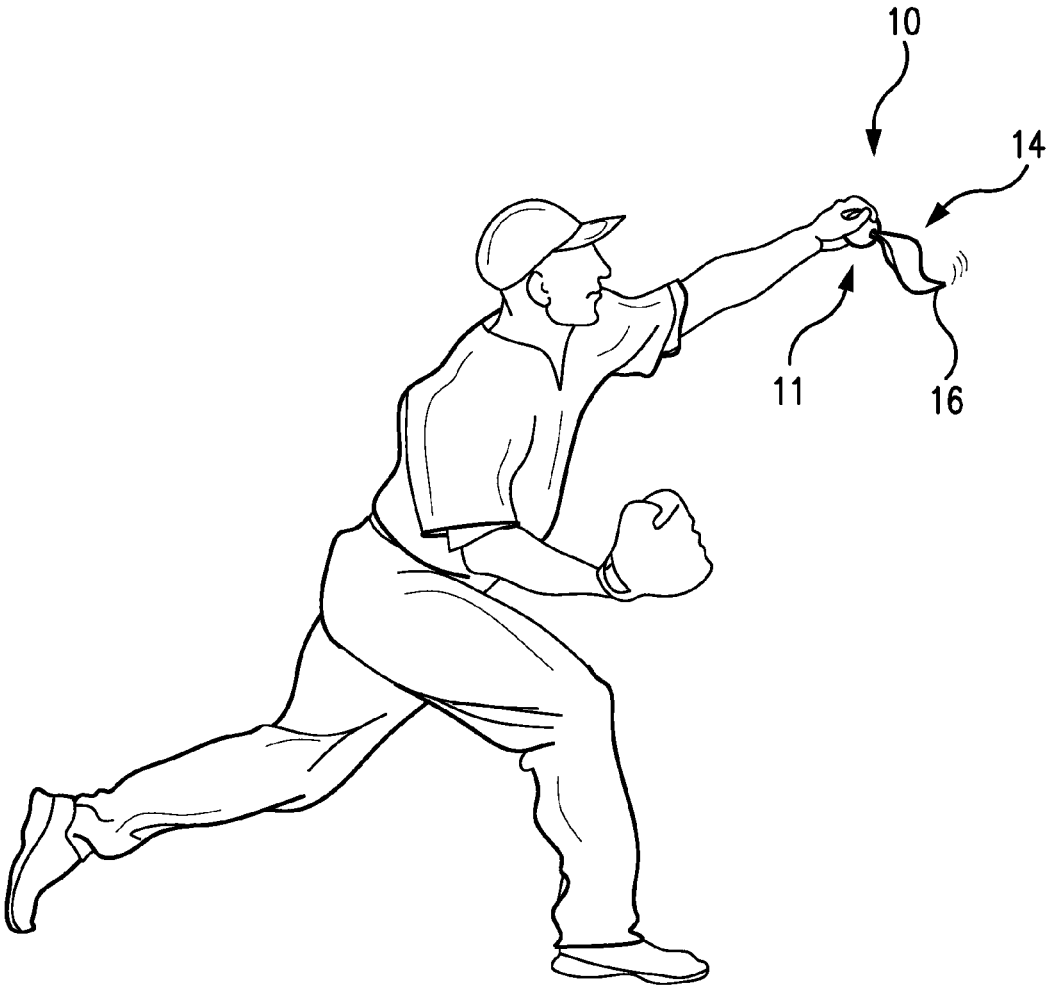
FIG. 3 is an illustration of a trainee pitcher completing his delivery using the baseball pitcher training device.

As depicted in FIG. 3, when the trainee pitcher completes his delivery with a full follow-through, the distal end 16 of the tail member 14 accelerates ahead of the ball 11 and vibrates with a snapping sound as it reaches its full extension.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A training device for improving the mechanics of a baseball pitcher's delivery, comprising:

a baseball having horseshoe-shaped seams and having one or more apertures located between the seams;

a tail member, consisting of a pliable sheet, wherein the tail member is attached to the baseball through one of the one or more apertures; and wherein the tail member is rotatably attached to the baseball through conjugate coupling with one of one or more sockets within the baseball, so that the baseball is free to rotate independently of the tail member.

2. The training device of claim 1, wherein the baseball has multiple apertures, and wherein each aperture is positioned differently from other apertures in relation to the seams, and wherein the tail member has multiple alternative points of attachment to the baseball corresponding to the multiple apertures, thereby enabling multiple unobstructed grip configurations on the seams.

3. The training device as in either claim 1 or claim 2, wherein the tail member is substantially rectangular in shape, and wherein the tail member is attached to the baseball at a rectangular corner of the tail member.

4. A training device for improving the mechanics of a baseball pitcher's delivery, comprising:

a baseball having horseshoe-shaped seams and having one or more apertures located between the seams; and a tail member, consisting of a pliable sheet and having a proximal end and a distal end, wherein the tail member is removably and rotatably attached to the baseball through one of the one or more apertures by a spherical extension provided at the proximal end of the tail member, and wherein the spherical extension of the tail member couples conjugately and rotatably with one of one or more sockets within the baseball, so that the baseball rotates freely and independently of the tail member.

5. The training device of claim 4, wherein the baseball has multiple apertures, and wherein each aperture is positioned differently from other apertures in relation to the seams, and wherein the tail member has multiple alternative points of attachment to the baseball corresponding to the multiple apertures, thereby enabling multiple unobstructed grip configurations on the seams.

6. The training device as in either claim 4 or claim 5, wherein the tail member is substantially rectangular in shape, and wherein the tail member is attached to the baseball at a rectangular corner of the tail member.

* * * * *